US006905574B2

(12) United States Patent
Festor

(10) Patent No.: US 6,905,574 B2
(45) Date of Patent: Jun. 14, 2005

(54) MULTI-LAYER FORMING FABRIC WITH TWO WARP SYSTEMS BOUND TOGETHER WITH A TRIPLET OF BINDER YARNS

(75) Inventor: Bernard Festor, Logelbach (FR)

(73) Assignee: Albany International Corp., Albany, NY (US)

( * ) Notice: Subject to any disclaimer, the term of this patent is extended or adjusted under 35 U.S.C. 154(b) by 16 days.

(21) Appl. No.: 10/418,675

(22) Filed: Apr. 18, 2003

(65) Prior Publication Data

US 2004/0206414 A1 Oct. 21, 2004

(51) Int. Cl.[7] ..... D21F 1/10; D21F 7/12

(52) U.S. Cl. ..... 162/348; 162/358.2; 162/900; 162/902; 162/903; 139/383 A

(58) Field of Search ..... 162/109–117, 358.2, 162/348, 306, 900–904; 139/383 A, 425 A; 28/110, 142; 442/203–207; 428/152–154; 34/116, 123

(56) References Cited

U.S. PATENT DOCUMENTS 4,501,303 A 2/1985 Osterberg
5,152,326 A * 10/1992 Vohringer ..... 139/383 A
5,482,567 A * 1/1996 Barreto ..... 139/383 A
5,709,250 A 1/1998 Ward et al.
5,826,627 A 10/1998 Seabrook et al.
5,829,489 A * 11/1998 Kuji ..... 139/383 A
5,937,914 A 8/1999 Wilson
5,967,195 A 10/1999 Ward
6,145,550 A 11/2000 Ward
6,202,705 B1 * 3/2001 Johnson et al. ..... 139/383 A
6,223,780 B1 5/2001 Kaldenhoff
6,240,973 B1 6/2001 Stone et al.
6,354,335 B1 * 3/2002 Taipale et al. ..... 139/383 A

FOREIGN PATENT DOCUMENTS

CA 2352898 * 10/2001 ..... D21F/7/08
EP 0 905 310 A2 3/1999

* cited by examiner

*Primary Examiner*—Eric Hug
(74) *Attorney, Agent, or Firm*—Frommer Lawrence & Haug LLP; Ronald R. Santucci

(57) ABSTRACT

A papermaker's fabric, usable in the forming section of a paper machine, has a top layer and a bottom layer of machine-direction (MD) warps and cross-machine direction (CD) wefts and a triplet of CD binder yarns interwoven with the top and bottom fabric layers. The triplet of binder yarns combine to weave a plain pattern in the top layer, thereby reducing sheet marking and providing a high level of web support.

13 Claims, 3 Drawing Sheets

MULTI-LAYER FORMING FABRIC WITH TWO WARP SYSTEMS BOUND TOGETHER WITH A TRIPLET OF BINDER YARNS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric usually woven from monofilaments and may be single-layered or multi-layered. The yarns are typically extruded from any one of several synthetic polymeric resins, such as polyarnide and polyester resins, used for this purpose by those of ordinary skill in the paper machine clothing arts.

The design of forming fabrics additionally involves a compromise between the desired fiber support and fabric stability. A fine mesh fabric may provide the desired paper surface properties, but such design may lack the desired stability resulting in a short fabric life. By contrast, coarse mesh fabrics provide stability and long life at the expense of fiber support. To minimize the design tradeoff and optimize both support and stability, multi-layer fabrics were developed. For example, in double and triple layer fabrics, the forming side is designed for support while the wear side is designed for stability and drainage.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper. See e.g., Osterberg (U.S. Pat. No. 4,501,303), the contents of which are incorporated herein by reference.

In order to further improve the integrity of the fabric and sheet support, triple layer fabrics were created incorporating binder pairs. These pairs of binders are incorporated into the structure in a variety of weave patterns and picking sequences. See e.g., Seabrook et al. (U.S. Pat. No. 5,826,627) and Ward (U.S. Pat. No. 5,967,195), the contents of which are incorporated herein by reference The present invention is a forming fabric having a triple layer weave construction formed using a triplet of binder yarns. The present invention provides a solution to the tradeoff between desired fiber support and fabric stability.

SUMMARY OF THE INVENTION

Accordingly, the present invention is a forming fabric, although it may find application in the forming, pressing and drying sections of a paper machine.

The present invention is a forming fabric having a triple layer weave construction formed using a triplet of cross-machine direction (CD) binder yarns. To address the tradeoff between desired fiber support and fabric stability, the triplet of binder yarns combine to weave a plain weave pattern in the top layer. This triplet binder might increase the potential support for the paper fiber on the forming side due to the high number of web supporting yarns and the decreased distance between CD yarns which support the fibers which are oriented in a preferred machine direction. The triplet binder increases the variety of geometrical shapes for the openings (holes) on the surface of the fabric and by consequence decreases the potential for so called diagonal dewatering marking in the paper sheets formed by this structure.

This increased variety of geometrical shapes for the opening will break up the diagonal structure in the upper layer of the fabric formed by the triplet of binders. In addition, the present invention increases the number of binding points and improves the binding function between the fabric layers. This construction decreases the relative movement between the layers when the forming fabric is under tension during operation and reinforces the fabric's resistance against internal binder wear.

The fabric is a forming fabric having a top layer and a bottom layer of machine-direction (MD) warp yarns and cross-machine direction (CD) wefts and a triplet of weft binder yarns interwoven with the top and bottom layers of MD warps. The triplet of binder yarns combine to weave a plain weave pattern in the top layer matching the weave of the topside warp and weft yarns, thereby reducing sheet marking and providing a high level of web support.

In a preferred embodiment, the fabric is a triple layer forming fabric with a first system of MD warp yarns and CD weft yarns forming the forming side of the fabric and a second system of MD warp yarns and CD weft yarns forming the wear side of the fabric, this compound fabric bound together with a system of triplet binder yarns.

Other aspects of the present invention include that the triplet is preferably used with two layers of warp and two or more weft layers. The triplet will be woven using a 3 to 10 harness weave pattern configuration. Further, the triplet may be straight or reverse picked. The yarns of this triplet may be woven in a pattern to maintain a plain weave on the top layer. Between each binder triplet, 1, 2 or more CD wefts may be woven. One or more of the triplet yarns may pass over one or more warps in the bottom layer or make a partial plain weave pattern on the bottom layer or weave in pattern with the CD wefts. If the triplet of binders is considered as one 'virtual' compounded weft, the ratio between the top layer and bottom layer weft is preferably 1:1, 2:1, 3:1, 3:2, 4:3, or 5:4.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention is a triple layer forming fabric woven with at least two warp systems and two or more layers of wefts. One warp system of yarns weaves with one weft system of yarns. A second warp system of yarns weaves with a second system of weft yarns. Optionally, a third layer of wefts may be inserted between the first and second weft CD yarns in a stacked or unstacked weave. This compound triple layer fabric is bound together with a triplet of binder yarns. The binder yarns act to bind the fabric layers together by weaving over and under both the first and second systems of warp yarns and in between both systems of CD weft yarns. An advantage of using a triple layer fabric is the ability to provide a plain weave on the forming surface (to minimize marking and provide a high level of web support). Hence, the three binder yarns are woven in a sequence to provide a plain weave surface structure. The triplet of binder yarns also act as support yarns on the paper side of the forming fabric.

Figure 1:
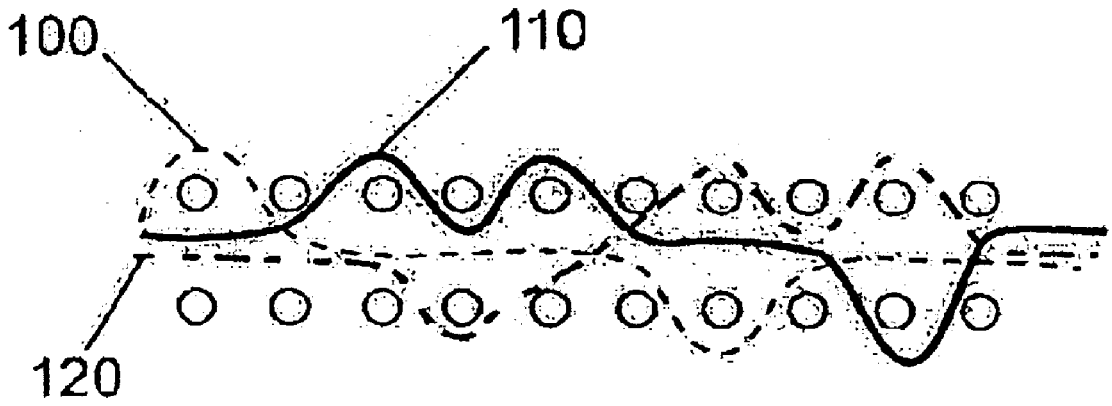
FIG. 1 is a schematic cross-sectional view showing the contour of a binder triplet in a fabric pattern in accordance with the teachings of the present invention.

FIG. 1 is a schematic cross-sectional view showing the contour of the binder triplet in a fabric pattern in accordance with the teachings of the present invention. As shown in FIG. 1, the three binder yarns 100, 110, and 120 weave between the top (forming side or paper side) layer and the bottom (wear side or machine side) layer. Note how together the triplet weaves together to form a plain weave pattern in the top layer.

The binder yarns in the triplet may weave with 1, 2, or more consecutive warps in the plain weave (i.e. 2-harness, 3-harness, 4-harness, 5-harness weaving). Similarly, the bottom layer of the fabric can be a 3, 4, 5, 6, 7, 8, 9, or 10 shed pattern.

An exemplary embodiment of the present invention is a 5-harness weave pattern where the triplet yarns follow different sequences; e.g. 2-2-1, 2-2-1 or 2-2-1, 1-2-2. In a 2-2-1 sequence, the first binder weaves a plain weave with two top warps, followed by the next binder which also weaves with two top warps, while the last binder only weaves over one top warp. Likewise, for a 6-harness weave pattern, the triplet may follow the sequences of 2-2-2, 2-2-2; 3-2-1, 1-2-3; or 1-2-3, 1-2-3. The present invention is not to be limited to this pattern, and in fact encompasses many weave patterns.

The present invention is a forming fabric having a triple layer weave construction formed using a triplet of binder yarns. The triplet is preferably used with two layers of warp and two or more weft layers. The triplet will be woven using a 3 to 10 harness weave pattern configuration. Further, the triplet may be straight or reverse picked. As discussed in reference to FIG. 1, the yarns of this triplet are woven in a pattern to maintain a plain weave on the top layer. Between each binder triplet, 1, 2 or more wefts may be woven. One or more of the triplet yarns may pass over one or more warps in the bottom layer or make a partial plain weave pattern on the bottom layer, or weave in sequence with the bottom CD weft yarn system pattern. If the triplet of binders is considered as one 'virtual' compounded weft, the ratio between the top layer and bottom layer weft is preferably 1:1, 2:1, 3:1, 3:2, 4:3, or 5:4.

To address the tradeoff between desired fiber support and fabric stability, the triplet of binder yarns combine to weave a plain weave pattern in the top layer. This triplet binder might increase the potential support for the paper fiber on the forming side due to the high number of web supporting yarns and the decreased distance between CD yarns which support the fibers which are oriented in a preferred machine direction. The triplet binder increases the variety of geometrical shapes for the openings (holes) on the surface of the fabric and by consequence decreases the potential for so called diagonal dewatering marking in the paper sheets formed by this structure. This increased variety of geometrical shapes for the opening will break up the diagonal structure in the upper layer of the fabric formed by the triplet of binders.

Another advantage to the present invention is that the number of binding points increases and improves the binding function between the fabric layers. This construction decreases the relative movement between the layers when the forming fabric is under tension during operation and reinforces the fabric's resistance against internal wear.

Figure 2A:
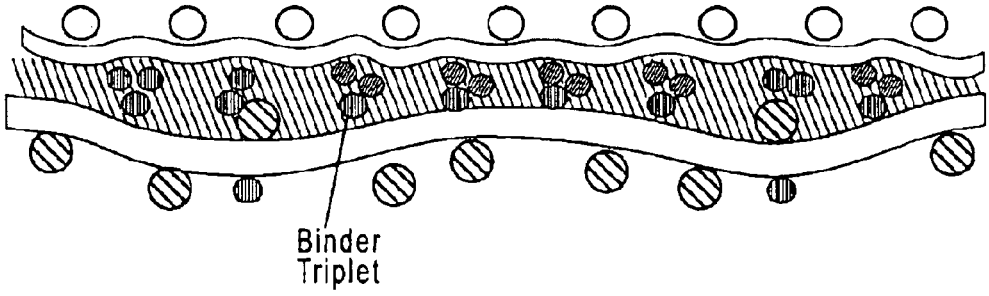
FIG. 2 shows cross-sectional views of a) a warp contour and b) a weft contour for a fabric woven in accordance with the teachings of the present invention.
Figure 2B:
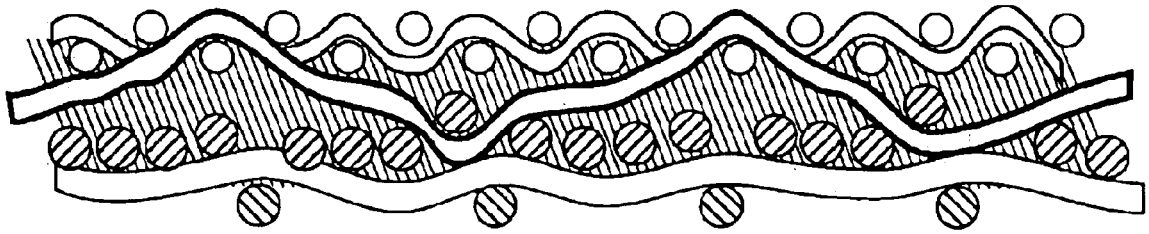
Figure 3A:
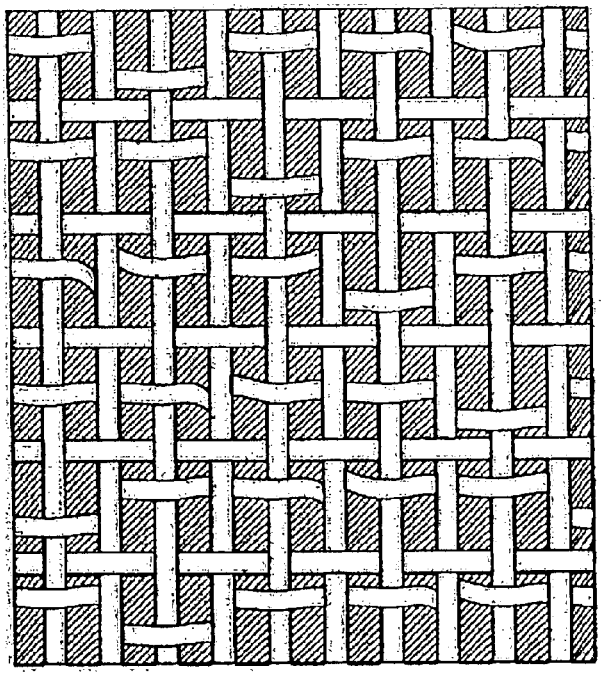
FIG. 3 shows a) a forming side view and b) a wear side view of a fabric woven in accordance with the teachings of the present invention.
Figure 3B:
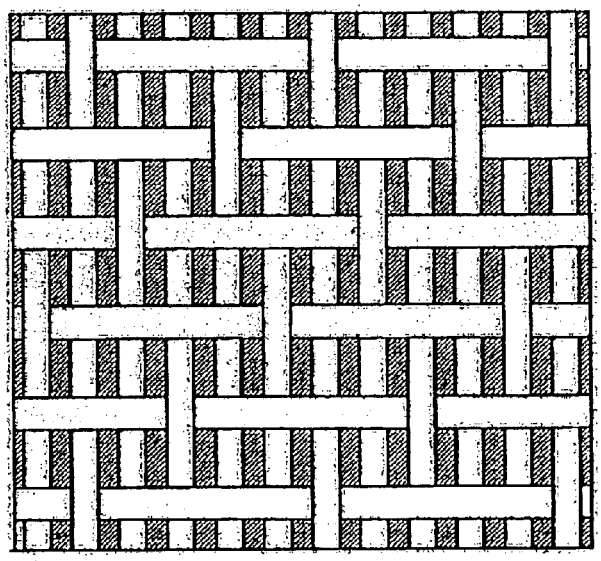

A sample forming fabric has been produced in accordance with the teachings of the present invention. FIG. 2 shows cross-sectional views of a) a warp contour and b) a weft contour for a fabric woven in accordance with the teachings of the present invention. FIG. 3 shows a) a forming side view and b) a wear side view of a fabric woven in accordance with the teachings of the present invention. Note the plain weave pattern of the forming side surface shown in FIG. 3*a*.

Experimentation with the sample fabric indicates that in order to increase the number of support points when forming the paper, the diameters of the triplet binder yarns should preferably be at least 0.01 mm smaller than the paper side's largest warp diameter. For example, if the top warp diameter is 0.13 mm the diameter of each binder should not be greater than 0.12 mm.

The fabric according to the present invention preferably comprises only monofilament yarns, preferably of polyester, polyarnide, or other polymer such as polybutylene terephthalate (PBT) or polyethylene napthalate (PEN). Bicomponent or sheath/core yarns can also be employed. Any combination of polymers for any of the yarns can be used as identified by one of ordinary skill in the art. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

In summary, the triplet of binder yarns in the present invention provides three primary advantages: 1) the yarns potentially increase support for the paper fibers, 2) the yarns decrease the potential for drainage marking on the formed paper sheet by creating a variety of openings in the surface which can be used to break up diagonal trends in the forming surface, and 3) the yarns increase the number of binding points to improve the binding function of the fabric layers.

Modifications to the above would be obvious to those of ordinary skill in the art, but would not bring the invention so modified beyond the scope of the present invention. The claims to follow should be construed to cover such situations.

What is claimed is:

1. A papermakers fabric comprising:

a first layer formed of a first system of machine-direction (MD) warp yarns interwoven with a first system of cross machine-direction (CD) weft yarns;

a second layer formed of a second system of MD warp yarns interwoven with a second system of CD weft yarns; and a system of weft binder yarns woven as a triplet binding the first layer and second layer together to form a compound triple layer fabric.

2. The papermaker's fabric according to claim 1, wherein the first system of MD warp yarns and CD weft yarns forms a forming side of the fabric and the second system of MD warp yarns and CD weft yarns forms a wear side of the fabric.

3. The papermaker's fabric according to claim 1, wherein the triplet of binder yarns are woven using a 3 to 10 harness weave pattern configuration.

4. The papermaker's fabric according to claim 1, wherein the triplet of binder yarns are woven so as to break up any diagonal structure in the first layer.

5. The papermaker's fabric according to claim 1, wherein the yarns in the triplet of binder yarns may be straight picked or reverse picked.

6. The papermaker's fabric according to claim 1, wherein each yarn in the triplet of binder yarns is woven in a staggered pattern to produce a plain weave in the first layer.

7. The papermaker's fabric according to claim 1, wherein one, two, or more CD wefts are woven between each binder triplet.

8. The papermaker's fabric according to claim 1, wherein at least one of the triplet yarns passes over at least one warp in the second layer or produces a partial plain weave pattern in the second layer, or weaves in sequence with the second layer CD weft yarns.

9. The papermaker's fabric according to claim 1, wherein if the triplet of binder yarns is considered as CD weft yarn in the first layer, the ratio between the number of CD weft yarns in the first layer and the number of CD weft yarns in the second layer is 1:1, 2:1, 3:1, 3:2, 4:3, or 5:4.

10. The papermaker's fabric according to claim 1, wherein at least some of the MD yarns are one of polyamide, polyester, polybutylene terephthalate (PBT), or polyethylene napthalate (PEN) yarns.

11. The papermaker's fabric according to claim 1, wherein at least some of the CD wefts are one of polyamide, polyester, polybutylene terephthalate (PBT), or polyethylene napthalate (PEN) yarns.

12. The papermaker's fabric according to claim 1, wherein the fabric is a forming, pressing, or drying type of fabric.

13. The papermaker's fabric according to claim 1, wherein any of the MD warp yarns, CD wefts, or binder yarns have a circular cross-sectional shape, a rectangular cross-sectional shape or a non-round cross-sectional shape.

* * * * *